US010577061B2

(12) United States Patent
Taylor

(10) Patent No.: US 10,577,061 B2
(45) Date of Patent: Mar. 3, 2020

(54) SHIPLIFT PLATFORM WITH MOVABLE CONNECTORS FOR CONNECTING WITH PIERS

(71) Applicant: Robert Taylor, Santa Barbara, CA (US)

(72) Inventor: Robert Taylor, Santa Barbara, CA (US)

(73) Assignee: Bardex Corporation, Goleta, CA (US)

( * ) Notice: Subject to any disclaimer, the term of this patent is extended or adjusted under 35 U.S.C. 154(b) by 121 days.

(21) Appl. No.: 15/817,876

(22) Filed: Nov. 20, 2017

(65) Prior Publication Data

US 2019/0106184 A1 Apr. 11, 2019

Related U.S. Application Data

(60) Provisional application No. 62/568,921, filed on Oct. 6, 2017.

(51) Int. Cl.
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC ..... B63C 3/06
See application file for complete search history.

(56) References Cited

U.S. PATENT DOCUMENTS 47,501 A * 4/1865 Turner ..... B63C 3/06 114/48
256,608 A * 4/1882 Watts ..... B63C 3/06 405/3
3,073,125 A * 1/1963 Pearlson ..... B63B 9/00 405/3
3,276,211 A * 10/1966 Drake ..... B63C 1/02 114/45
RE27,090 E * 3/1971 Rutter ..... B63B 9/00 405/3

(Continued)

FOREIGN PATENT DOCUMENTS

WO WO-9222457 A1 * 12/1992 ..... B63C 3/06

OTHER PUBLICATIONS

International Search Report and Written Opinion dated Apr. 5, 2018 (issued in PCT Application No. PCT/US2017/066806) [15 pages].

*Primary Examiner* — Frederick L Lagman
(74) *Attorney, Agent, or Firm* — Michael S. McCoy; Amatong McCoy LLC

(57) ABSTRACT

A shiplift includes a pier defining a space. The pier includes lifting apparatus. The shiplift includes a shiplift platform configured to fit within the space defined by the pier. One or more movable connectors are mechanically coupled to the shiplift platform. Each movable connector is configured to move into at least two positions, including a first position and a second position. In the first position, the movable connectors are mechanically coupled to the shiplift platform and positioned to allow the shiplift platform to enter the space defined by the pier. In the second position, the movable connectors are mechanically coupled to the shiplift platform and positioned to mechanically couple to the lifting apparatus of the pier.

30 Claims, 9 Drawing Sheets

(56) References Cited

U.S. PATENT DOCUMENTS

| | | | | | |
|---|---|---|---|---|---|
| 3,857,248 | A | * | 12/1974 | Rutter | B63C 3/06 114/45 |
| 3,978,676 | A | * | 9/1976 | Chambers | B63C 3/06 405/4 |
| 4,087,979 | A | * | 5/1978 | Pearlson | B63C 3/06 405/3 |
| 4,329,082 | A | * | 5/1982 | Gillis | E02C 5/00 114/48 |
| 4,381,723 | A | * | 5/1983 | Furst | B63C 3/02 114/45 |
| 4,750,444 | A | * | 6/1988 | Lemvig | B63C 3/06 114/45 |
| 4,934,298 | A | * | 6/1990 | Pritchett | B63C 3/06 114/44 |
| 5,178,488 | A | * | 1/1993 | Stokoe | B63B 9/08 114/48 |
| 5,378,082 | A | | 1/1995 | Hiller et al. | |
| 5,551,366 | A | * | 9/1996 | Kavanaugh | B63C 3/06 114/262 |
| 5,641,242 | A | * | 6/1997 | Riviere | B63C 3/06 114/263 |
| 5,655,850 | A | * | 8/1997 | Holmgren | B63C 1/02 114/48 |

* cited by examiner

SHIPLIFT PLATFORM WITH MOVABLE CONNECTORS FOR CONNECTING WITH PIERS

CROSS-REFERENCE TO RELATED APPLICATIONS

The present application claims the benefit of U.S. Provisional Patent Application No. 62/568,921, filed on Oct. 6, 2017, the entirety of which is incorporated herein by reference.

FIELD

The present disclosure relates to a shiplift platform with movable connectors, to methods of use thereof, and to methods of making the same.

BACKGROUND

Shiplifts are used to dry dock and launch ships. Shiplifts typically include a structural platform that is lifted and lowered by hoists. Existing shiplift platform designs typically have arms that reach underneath piers on either side of the platform so that the hoists (e.g., chain jacks or winches) can be connected to the shiplift platform structure via chains or wire ropes. These hoists operate to lift and lower the shiplift platform, with or without a ship on it. Typically, the shiplift platform is lowered underwater, a ship is floated above the shiplift platform, and the shiplift platform and ship are then lifted.

A problem with such designs is that, when the shiplift platform is being installed onto the pier, arms of the shiplift platform must be positioned between the pilings that hold up the pier. Two methods of achieving this include: 1) the use of removable end connections that are removed from the shiplift platform while the shiplift platform is being floated into position adjacent the pier, and then installed onto the shiplift platform after the shiplift platform has been floated into position adjacent to the pier for connection between the shiplift platform and the hoists; and 2) tipping the shiplift platform upwards to a steep angle using cranes, and then lowering the shiplift platform into position adjacent to the pier. Both of these methods offer challenges.

Shiplift end weldments of shiplift platforms must overcome several design challenges. The structure must extend under the support pile caps of the pier to connect with the lifting devices (i.e., hoists) supported on the pile caps. This connection typically requires a change of cross section in the main transverse girder of the shiplift platform to allow the top of the shiplift platform structure to be flush with the top of the pile cap. Prior shiplift platform designs have utilized weldments with complex geometry and multiple heavy plates to solve these two design challenges.

Shiplift platform designs using fixed end weldments also have installation challenges. The projecting end weldments are wider than the pile spacing and shiplift platform opening, which prevents the shiplift platform from being installed safely and efficiently at a pier. At least some such prior field installations of rigid shiplift platforms have required the performance of costly, in place welding and painting operations.

Shiplift platform sections, rigid or articulated, are sometimes installed by high-risk, heavy tandem lifts employing multiple cranes. During such installations, each shiplift platform section is typically tilted to 30° or more to allow the end weldments to pass through the openings between pile caps of the pier. While articulated shiplift platform designs reduce the amount of on-site field welding and painting operations, such designs still require high-risk, heavy tandem lifts during installation.

BRIEF SUMMARY

One aspect of the present disclosure includes a shiplift. The shiplift includes a pier defining a space, the pier including lifting apparatus. The shiplift includes a shiplift platform configured to fit within the space defined by the pier. Movable connectors are mechanically coupled to the shiplift platform. Each movable connector is configured to move into at least two positions. The two positions include a first position and a second position. In the first position, the movable connectors are mechanically coupled to the shiplift platform and positioned to allow the shiplift platform to enter the space defined by the pier. In the second position, the movable connectors are mechanically coupled to the shiplift platform and positioned to mechanically couple to the lifting apparatus of the pier.

Another aspect of the present disclosure includes a shiplift platform. Movable connectors are mechanically coupled to the shiplift platform. Each movable connector is configured to move into at least two positions, including a first position and a second position. In the first position, the movable connectors are mechanically coupled to the shiplift platform and positioned to allow the shiplift platform to enter a space defined by a pier. In the second position, the movable connectors are mechanically coupled to the shiplift platform and positioned to mechanically couple to lifting apparatus of a pier.

Another aspect of the present disclosure includes a method of installing a shiplift platform on a pier. The method includes providing a shiplift platform having movable connectors mechanically coupled therewith. The shiplift platform is configured to fit within a space defined by the pier. Each movable connector is configured to move into at least two positions, including a first position and a second position. In the first position, the movable connectors are mechanically coupled to the shiplift platform and positioned to allow the shiplift platform to enter the space defined by the pier. In the second position, the movable connectors are mechanically coupled to the shiplift platform and positioned to mechanically couple to the lifting apparatus of the pier. With the movable connectors in the first position, the method includes floating the shiplift platform into position within the space defined by the pier. After floating the shiplift platform into position within the space defined by the pier, the method includes moving the movable connectors from the first position into the second position. After moving the movable connectors into the second position, the method includes connecting lifting apparatus of the pier with the movable connectors.

Another aspect of the present disclosure includes a method of dry docking and launching floating vessels (e.g., ships). The method includes providing a shiplift. The shiplift includes a pier defining a space, the pier including lifting apparatus. The shiplift includes a shiplift platform configured to fit within the space defined by the pier. Movable connectors are mechanically coupled to the shiplift platform. Each movable connector is configured to move into at least two positions, including a first position and a second position. In the first position, the movable connectors are mechanically coupled to the shiplift platform and positioned to allow the shiplift platform to enter the space defined by the pier. In the second position, the movable connectors are mechanically coupled to the shiplift platform and positioned to mechanically couple to the lifting apparatus of the pier. The method includes lowering the shiplift platform to a position underneath the water using the lifting apparatus. After lowering the shiplift platform, the method includes receiving a floating vessel positioned above the shiplift platform, the floating vessel floated into the space defined by the pier. After receiving the floating vessel, the method includes raising the shiplift platform and the floating vessel to a position above the water using the lifting apparatus, thereby, dry docking the floating vessel. For launching a dry docked floating vessel, the method includes using the lifting apparatus to lower the shiplift platform with the floating vessel thereon to a position such that the shiplift platform is underneath the water and the floating vessel is floating in the water.

Another aspect of the present disclosure includes a method of making a shiplift platform. The method includes mechanically coupling movable connectors to a shiplift platform. Each movable connector is configured to move into at least two positions, including a first position and a second position. In the first position, the movable connectors are mechanically coupled to the shiplift platform and positioned to allow the shiplift platform to enter a space defined by a pier. In the second position, the movable connectors are mechanically coupled to the shiplift platform and positioned to mechanically couple to lifting apparatus of a pier.

One aspect of the present disclosure includes a shiplift platform. The shiplift platform includes hinged connectors configured to allow the shiplift platform to be installed into a facility (e.g., a pier). The hinged connectors allow a fully complete and assembled platform to be easily and quickly installed into the facility and removed for repair and/or refurbishment.

Some aspects of the present disclosure include a method of installing a shiplift platform. The method includes floating the shiplift platform into position, and then swinging hinged connections upwards from below the shiplift platform into position for connection with a lifting apparatus of the facility.

BRIEF DESCRIPTION OF THE DRAWINGS

So that the manner in which the features and advantages of the system, products, and/or method so of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Figure 1A:
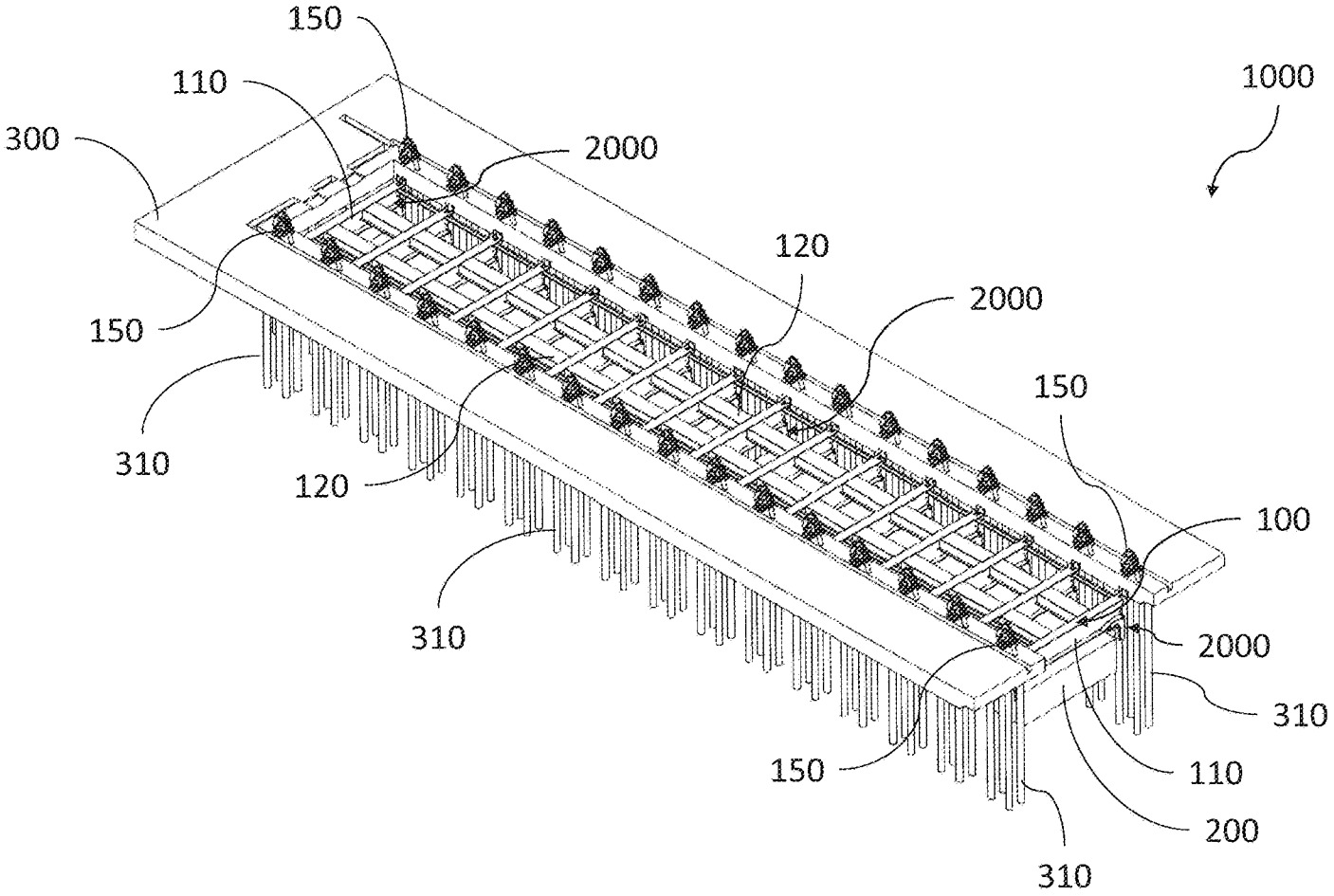
FIG. 1A depicts a shiplift platform in a transport configuration, on barges, and arranged for installation at a pier, in accordance with certain aspects of the present disclosure.
Figure 1B:
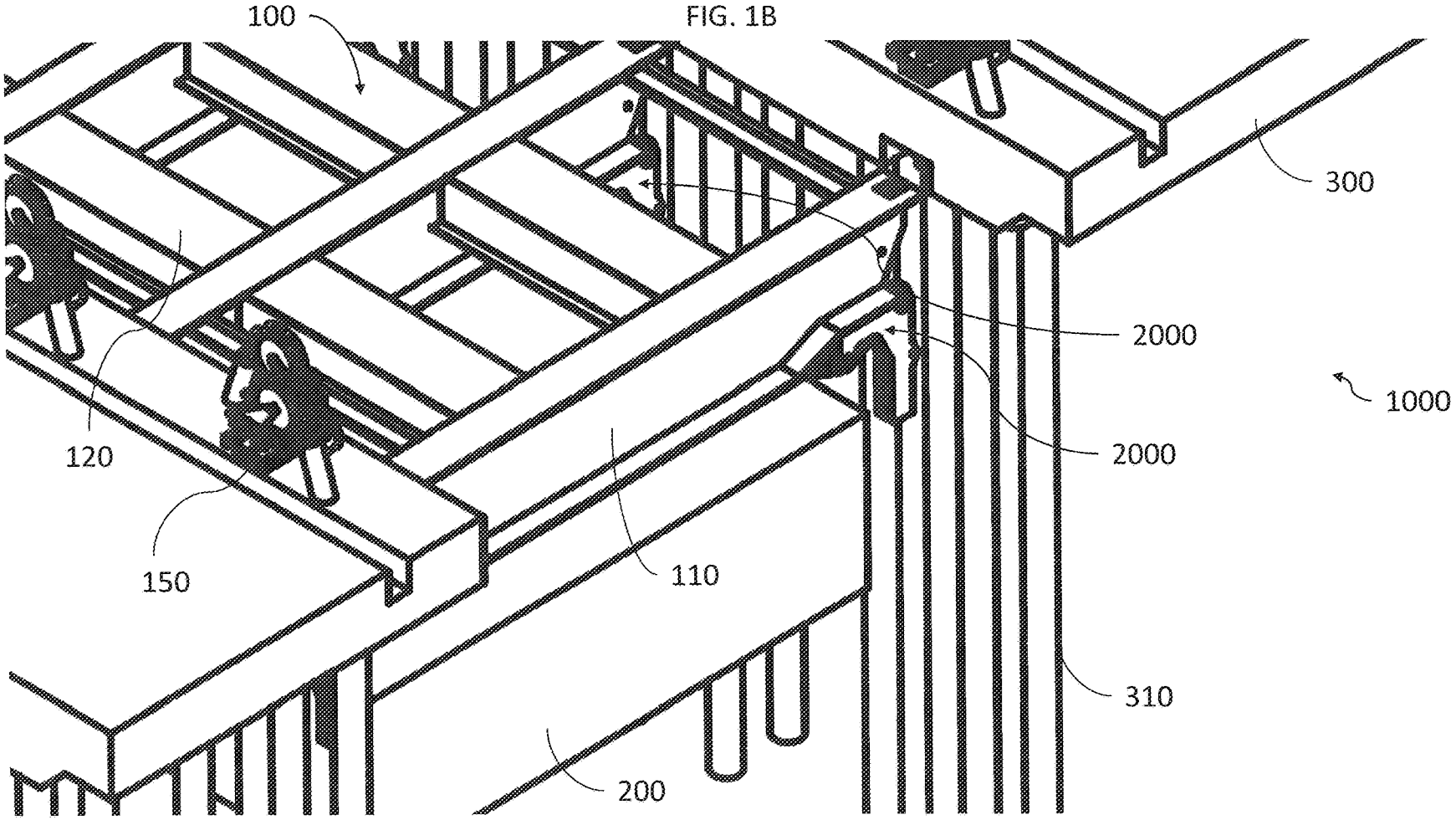
FIG. 1B depicts a detail view of a portion of the shiplift platform of FIG. 1A.

Products and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather these embodiments are provided so that this disclosure will be thorough as well as complete and will fully convey the scope of the various concepts to those skilled in the art and the best and preferred modes of practice.

DETAILED DESCRIPTION

Certain aspects of the present disclosure include a shiplift platform having movable connectors for connecting between the shiplift platform and a portion of an adjacent structure (e.g., a pier). For example, in some aspects, the movable connectors connect the shiplift platform to an adjacent pier, such as to hoists of the adjacent pier. Other aspects of the present disclosure relate to a shiplift including the shiplift platform coupled to a lifting apparatus of a pier via the movable connectors. Additional aspects of the present disclosure relate to methods of installing the shiplift platform at a pier using the movable connectors, methods of making the shiplift platform having the movable connectors, and methods of dry docking and launching ships using the shiplift platform having movable connectors.

With reference to FIGS. 1A to 2B, shiplift 1000 is depicted. Shiplift 1000 includes shiplift platform 100 and pier 300. Pier 300 is supported on a plurality of piles 310. Pier 300 includes a plurality of lifting apparatus 150 (e.g., hoists). Space 312 is formed between two portions of pier 300 and is sufficiently sized and shaped to receive shiplift platform 100 therein. For example, shiplift platform 100 may be floated into space 312 via barges 200. Shiplift platform 100 may be configured (e.g., sized and shaped) to fit within space 312.

Shiplift platform 100 includes a plurality of transverse girders 110 coupled with longitudinal supports 120. A plurality of movable connectors 2000 are coupled to shiplift platform 100. As shown, a first row of movable connectors 2000 are connected along a first longitudinal edge of shiplift platform 100 and a second row of movable connectors 2000 are connected along a second longitudinal edge of shiplift platform 100. Movable connectors 2000 may be any structure configured to be mechanically coupled to shiplift platform 100 in a first position (e.g., transport position or configuration) for transport and installation, and to move into a second position (e.g., install position or configuration) in which movable connectors 2000 are mechanically coupled to shiplift platform 100 and positioned to mechanically couple to lifting apparatus 150. Thus, movable connectors 2000 provide for selective mechanical coupling between shiplift platform 100 and lifting apparatus 150. The configuration of movable connectors 2000 may vary in size, shape, arrangement, positioning on shiplift platform 100, material composition, or combinations thereof. While movable connectors 2000 are shown in FIGS. 1A to 2B as being connected to transfers girders 110, one skilled in the art would understand that the shiplift platform disclosed herein is not limited to this arrangement, and that the movable connectors may be connected to another portion of the shiplift platform. Furthermore, while the shiplift platform is shown and described herein as including transverse girders coupled with longitudinal supports, one skilled in the art would understand that the shiplift platform disclosed herein is not limited to this particular configuration, structure, or arrangement, and that the shiplift platform may be any of a variety of structures capable of supporting a ship during lifting and docking thereof.

Figure 2A:
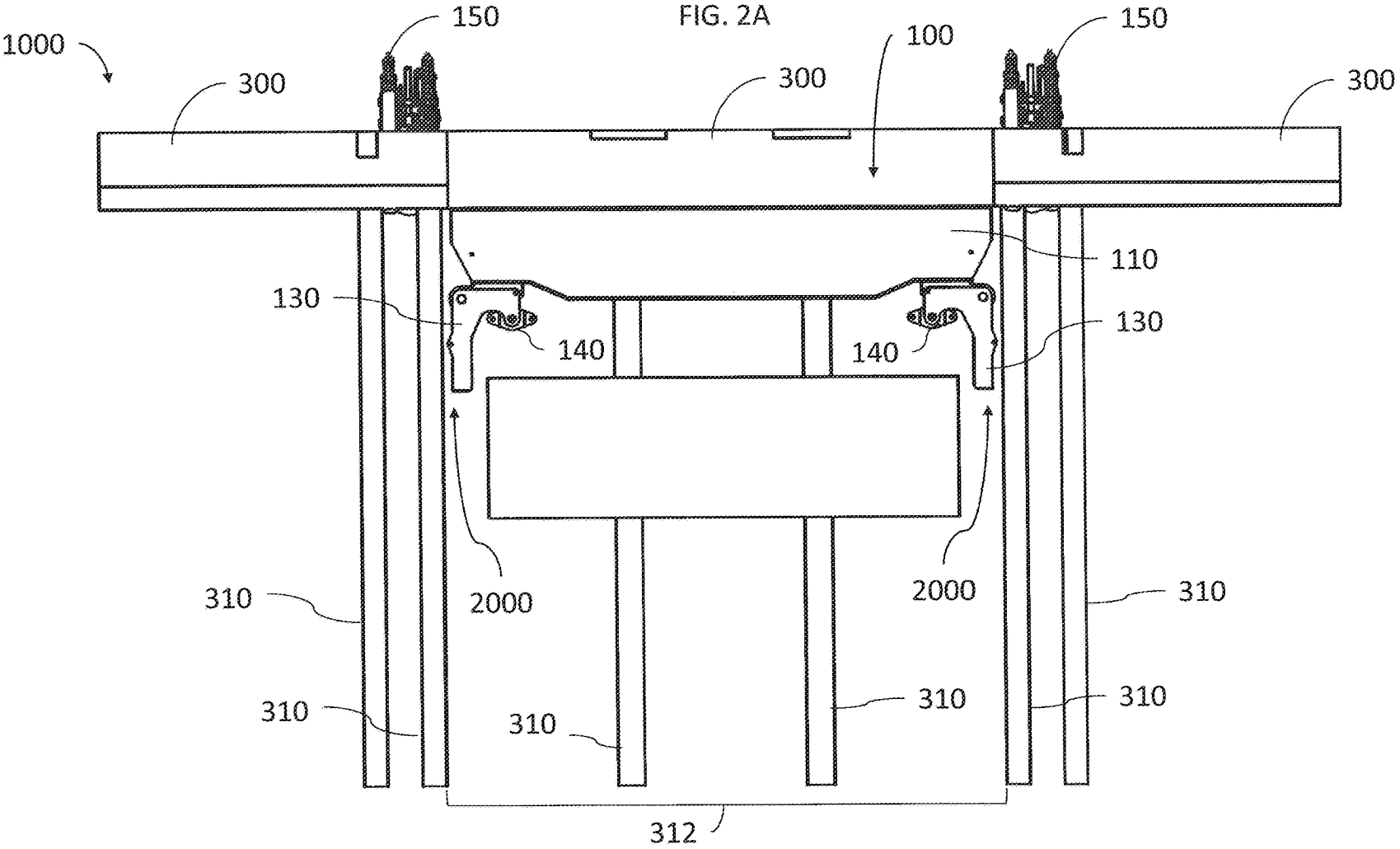
FIG. 2A depicts an end view of the shiplift platform of FIG. 1A, with hinges in a retracted position, in accordance with certain aspects of the present disclosure.
Figure 2B:
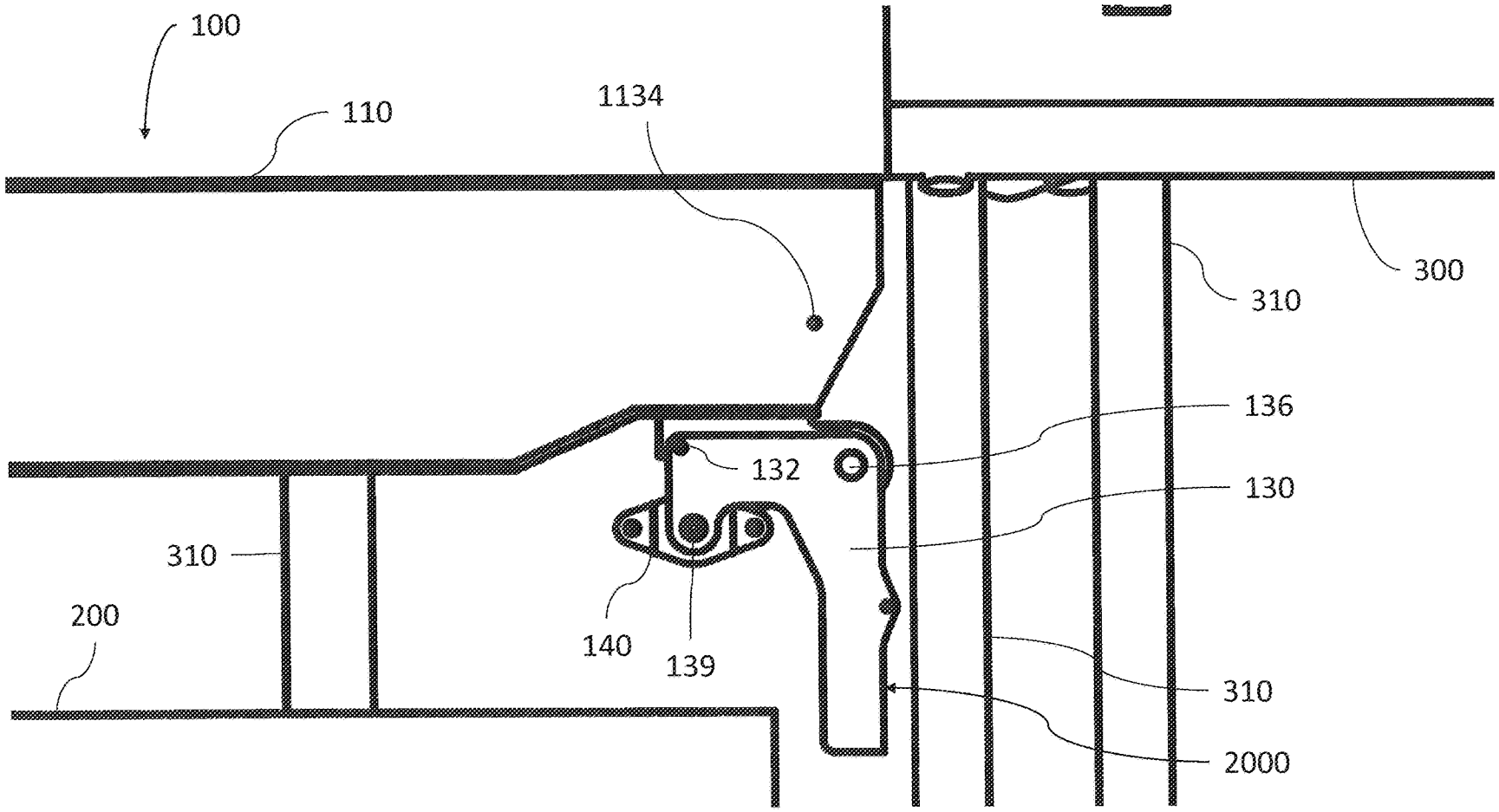
FIG. 2B depicts a detail view of a portion of the shiplift platform of FIG. 2A.
Figure 3A:
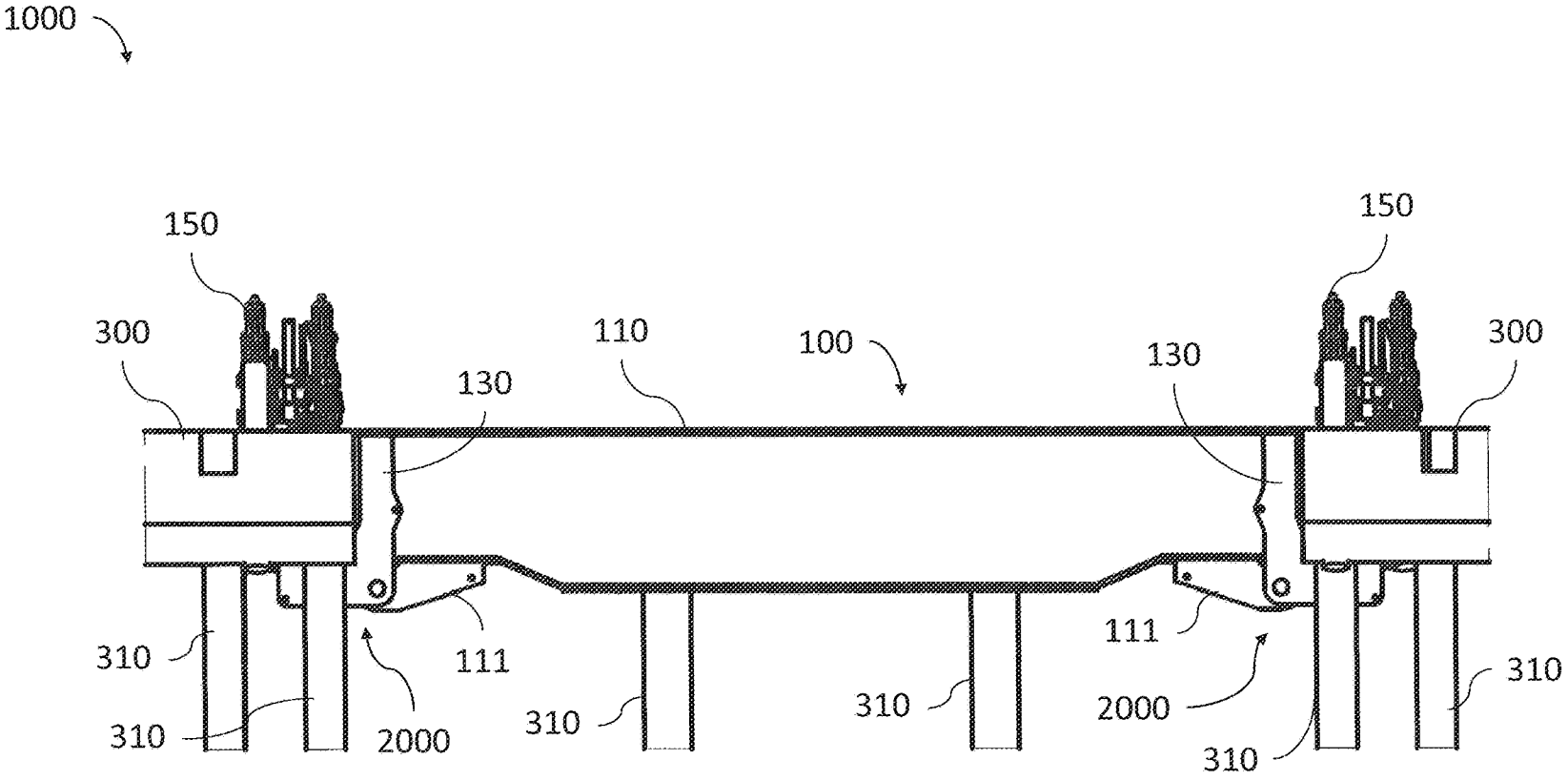
FIG. 3A depicts an end view of an installed shiplift platform, with hinges in a vertical position, in accordance with certain aspects of the present disclosure.
Figure 3B:
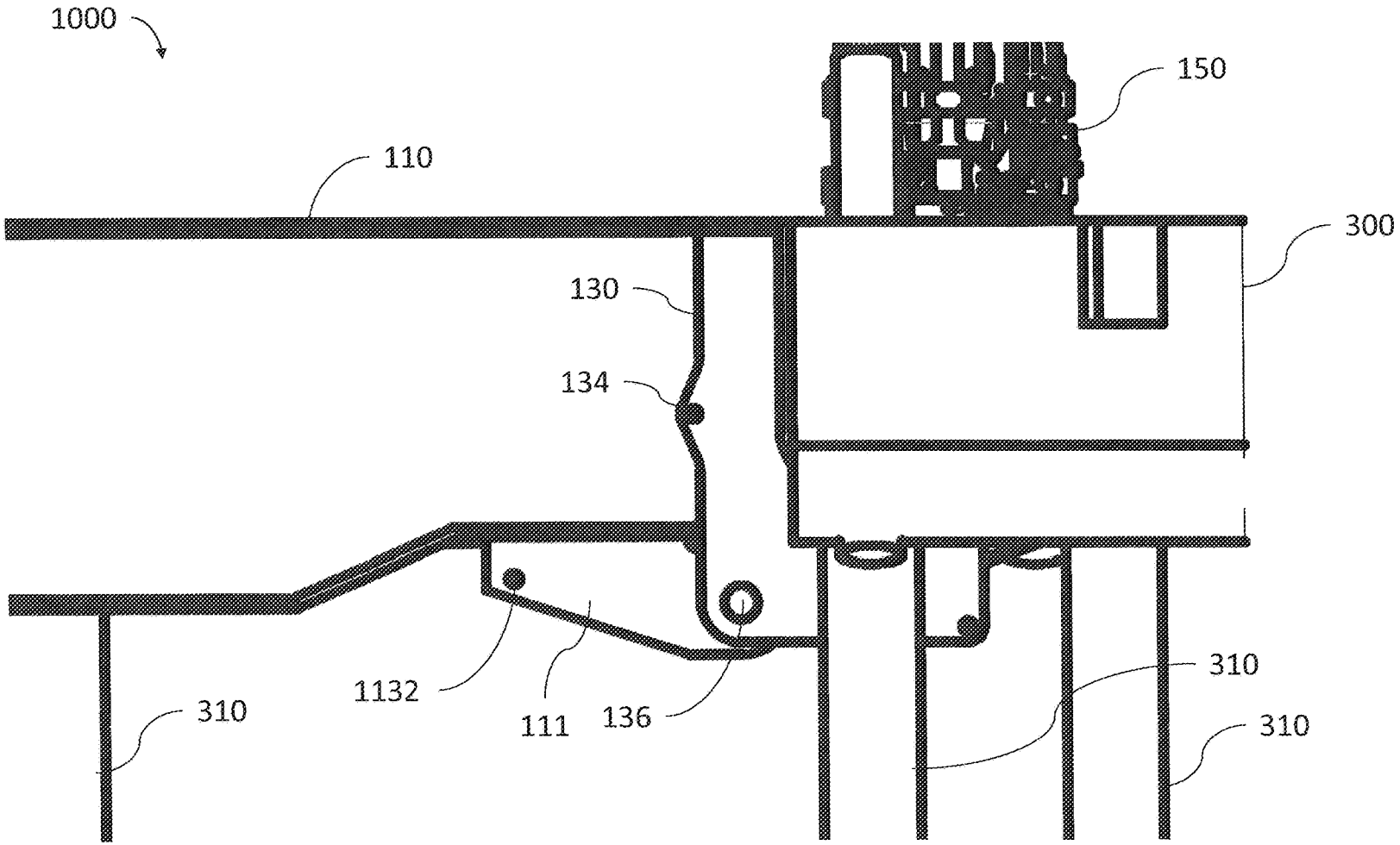
FIG. 3B depicts a detail view of a portion of the shiplift platform of FIG. 3A.
Figure 4A:
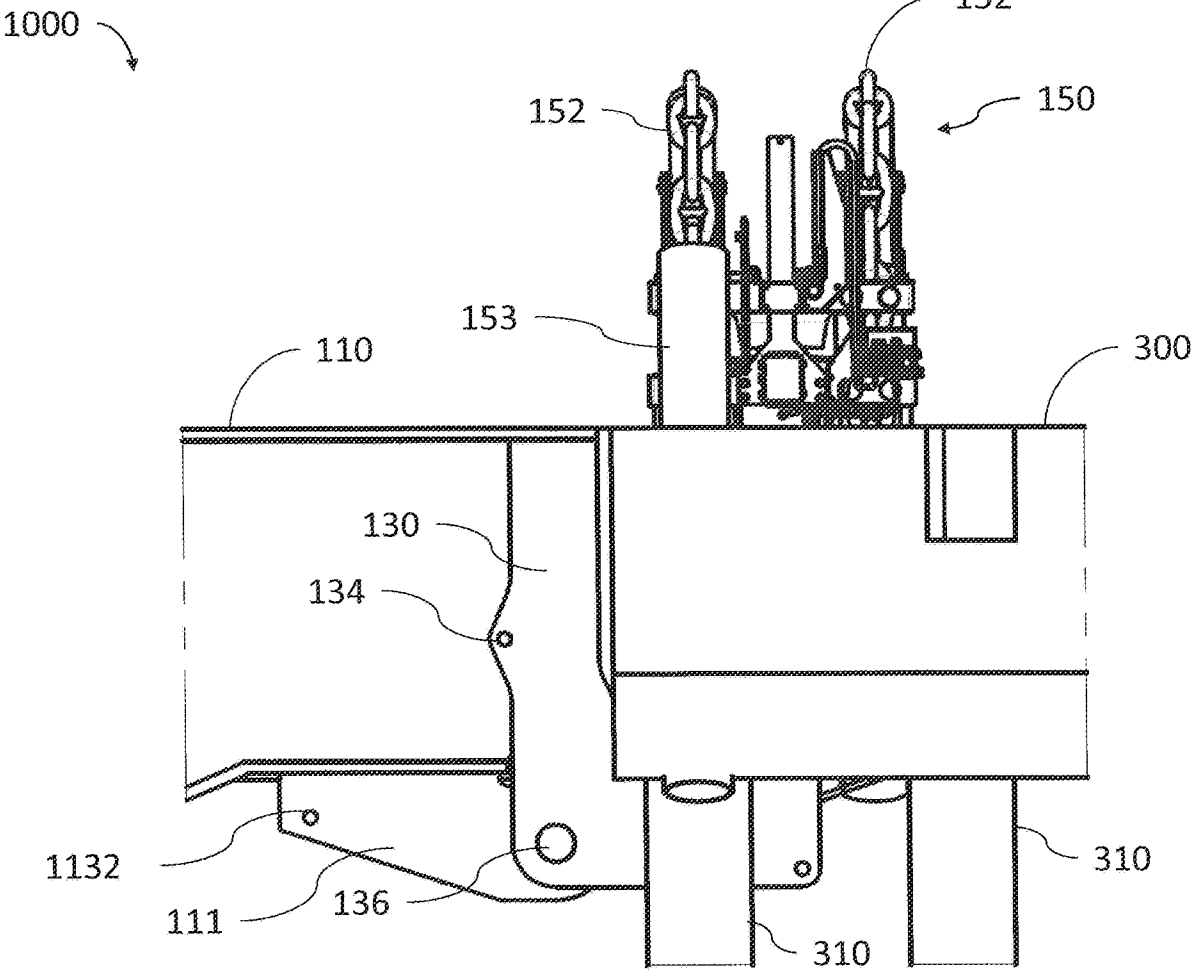
FIG. 4A depicts another detail view of a portion of the installed shiplift platform of FIG. 3A, in accordance with certain aspects of the present disclosure.
Figure 4B:
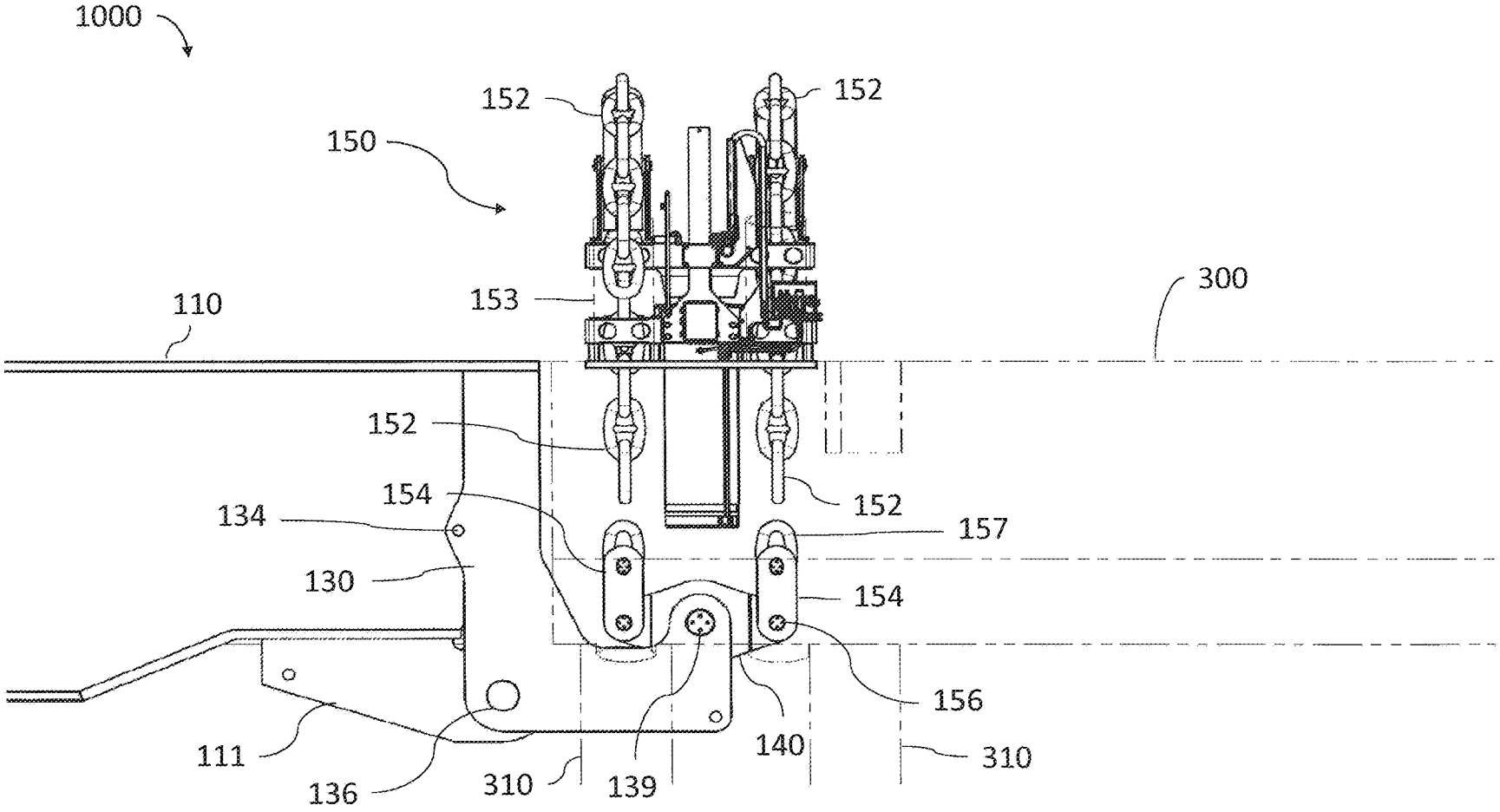
FIG. 4B depicts a cross-sectional view of the portion of the installed shiplift platform of FIG. 4A.

Movable connectors 2000 are configured to move between at least a first position, as shown in FIGS. 1A-2B, and a second position, as shown in FIGS. 3A-4B. In the first position, movable connectors 2000 are positioned, shaped, arranged, or combinations thereof to allow shiplift platform 100 to be floated into position adjacent pier 300, within space 312, without having to remove movable connectors 2000 from connection with shiplift platform 100. In the first position, movable connectors 2000 are positioned to not obstruct, interfere with, or prevent movement of shiplift platform 100 into space 312 between pier 300. As such, in the first position, movable connectors 2000 do not contact pier 300 or piles 310 thereof. For example, in the first, retracted position, movable connectors 2000 may be retracted to a position below shiplift platform, as shown in FIG. 2B.

Once shiplift platform 100 is positioned within space 312, adjacent pier 300, movable connectors 2000 are selectively movable from the first position into the second position, as shown in FIG. 3A-4B. Within the second position, movable connectors 2000 are positioned to connect with lifting apparatus 150 (e.g., winch or chain jack), such that lifting apparatus 150 may operate to selectively raise and lower shiplift platform 100. In some aspects, movable connectors 2000 are hydraulically or pneumatically operable to move between the first and second positions. In some aspects, movable connectors 2000 (or hinge plates 130 thereof) are lifted from the first position into the vertical, second position using a crane, such as a small mobile crane, or using a wire rope winch. One skilled in the art would understand that movement of movable connectors 2000 from the first to the second position may be accomplished in other ways, and is not limited to the examples described herein. Movable connectors 2000 are configured to remain connected to shiplift platform 100 while in the first position, while in the second position, and while therebetween. For example, movable connectors 2000 remain connected to shiplift platform 100 while in the first position, during transport of shiplift platform 100 and during positioning (e.g., floating) of shiplift platform 100 into space 312 adjacent pier 300. When moving movable connectors 2000 from the first position to the second position and connecting movable connectors 2000 to lifting apparatus 150, movable connectors 2000 are not disconnected from shiplift platform 100. As such, shiplift platform 100 may be transported, moved into position adjacent pier 300, and connected with lifting apparatus 150, all while movable connectors 2000 remain continuously attached thereto. Once installed at pier 300, shiplift platform 100 may be selectively raised and lowered via lifting apparatus 150 for dry docking and launching of ships (or other floating vessels). In some aspects, in the second position movable connectors 2000 are positioned, shaped, arranged, or combinations thereof such that shiplift platform 100 cannot be floated into position adjacent pier 300, within space 312, without having moving movable connectors 2000 into the first position. In some such aspects, in the second position movable connectors 2000 are positioned such that movable connectors 2000 would obstruct, interfere with, or prevent movement of shiplift platform 100 into space 312 between pier 300 without moving movable connectors 2000 into the first position. As such, in some such aspects, with movable connectors 2000 in the second position, movable connectors 2000 would contact pier 300 or piles 310 thereof if shiplift 100 were floated into space 312 without moving movable connectors out of the second position (e.g., into the first position).

In some aspects, movable connectors 2000 are pivotable between the first position and the second position. Some aspects of the present disclosure include a shiplift platform with main transverse plate girders having movable connectors that are hinged end supports (i.e., hinged connections). As shown in FIGS. 1A-4B, movable connectors 2000 are hinged connectors that connect via hinges, including hinge plates 130 and gimbal plates 140, to shiplift platform 100, such that movable connectors 2000 pivot between the first and second positions. However, one skilled in the art would understand that the movable connectors disclosed herein are not limited to this particularly arrangement or structure, and that the movable connectors disclosed herein may have any number of arrangements or structures that are capable of being selectively moved between a first position, connected on the shiplift platform in a manner that allows the shiplift platform to be floated into position adjacent a pier, and a second position, for connection between lifting apparatus and the shiplift platform.

As shown in FIGS. 1A-2B, shiplift platform 100 is depicted in a transport configuration, being carried by barges 200. Barges 200 may transport shiplift platform 100 in a completely finished state (i.e., in a fully assembled configuration) to the installation site (i.e., pier 300). As an example, and without limitation, shiplift platform 100 may be a 14 m wide×95 m long shiplift platform weighing 1,000 metric tonnes. However, one skilled in the art would understand that the shiplift platform disclosed herein is not limited to any particular dimensions or weight.

In the transport configuration, hinge plates 130 and gimbal plates 140 of movable connectors 2000 are installed onto a portion of girders 110 of shiplift platform 100. As shown, hinge plates 130 and gimbal plates 140 are installed onto portion 111 of girders 110 via pins 136 located on or about a bottom side of girders 110 (as shown in FIGS. 3A-4B). Hinge plates 130 are coupled to gimbal plates 140 via pins 139. In some aspects, gimbal plates 140 rotate freely relative to hinge plates 130. In some such aspects, the free rotation of gimbal plates 140 relative to hinge plates 130 provides load equalization between the lift chains 152 connecting to lifting apparatus 150 (e.g., chain jack). The installation of hinge plates 130 and gimbal plates 140, or more generally of movable connectors 2000, onto shiplift platform 100 may be performed at an assembly site of shiplift platform 100, optionally remote from pier 300. Shiplift platform 100 may then be shipped in the transport configuration, with hinge plates 130 and gimbal plates 140 in the first position (i.e., in a retracted position). Having movable connectors 2000 in the first position, i.e. having hinge plates 130 and gimbal plates 140 in the retracted position, provides clearance to maneuver shiplift platform 100 into the installation facility (i.e., into space 312 of pier 300). During transport and installation, shipping pins 132 are installed, fixedly coupling hinge plates 130 to transverse girders 110, to prevent hinge plates 130 from moving relative to transverse girders 110, enhancing safety and reducing or eliminating the risk of damage. Shipping pins 132 may engage within shipping pin holes 1132 for fixedly coupling hinge plates 130 to transverse girders 110.

Once shiplift platform 100 is positioned at the installation site, within space 312 of pier 300, movable connectors 2000 are moved from the first position to the second position, such that hinge plates 130 are pulled to the vertical or extended position, as shown in FIGS. 3A-4B. Hinge plates 130 are moved into the vertical or extended position by pivoting about pivot pins 136 (or hinge pins). In some aspects, pivot pins 136 is defines a point about which hinge plate 130 rotates to move between the first and second positions. Pivot pin 136 is attached to transverse girder 110. After moving into the second (vertical/extended position), hinge plates 130 are secured in the second position via locking pins 134 in preparation for connection with lifting apparatus 150. Locking pins 134 may engaged within locking pin holes 1134 of girders 110 for securing hinge plates 130 thereto.

Lift chains 152 of lifting apparatus 150 are lowered to connect with gimbal plates 140 by operating chain jacks of lifting apparatus 150. Lift chains 152 pass through pier 300 via conduits 153 extending therethrough. Chain pins 156 are installed to connect chain plates to gimbal plates 140. Chain plates 154 are coupled with lift chains 152 opposite gimbal plates 140, such as via chain links 157. Shiplift platform 100 is then lifted off barges 200, and barges 200 are removed (e.g., floated away) from space 312. In some such aspects, there is no need for access to the underside of shiplift platform 100 during installation thereof for welding and/or painting operations. Lifting apparatus 150 may then be used to selectively raise and lower shiplift platform 100. As lift chains 152 are drawn upwards, lift chains 152 pull shiplift platform 100 upwards via connection through chain plates 154, gimbal plates 140, and hinge plates 130. As lift chains 152 are lowered downwards, lift chains 152 lower shiplift platform 100 downwards via connection through chain plates 154, gimbal plates 140, and hinge plates 130. One skilled in the art would understand that the shiplift disclosed herein is not limited to the particular lifting apparatus as shown in the Figures, and is not limited to the particular manner of connection between the lifting apparatus and the movable connectors as shown in the Figures.

Figure 5B:
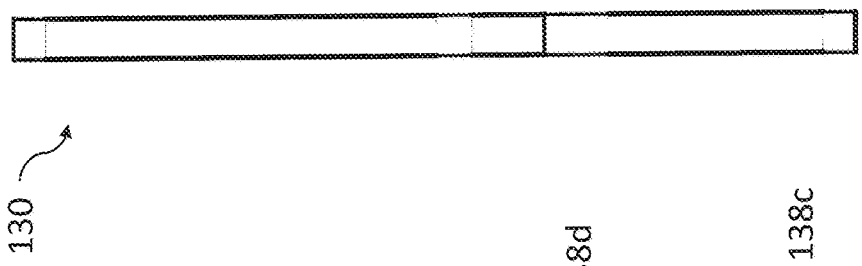
FIG. 5B depicts an end view of the hinge plate of FIG. 5A, in accordance with certain aspects of the present disclosure.
Figure 5A:
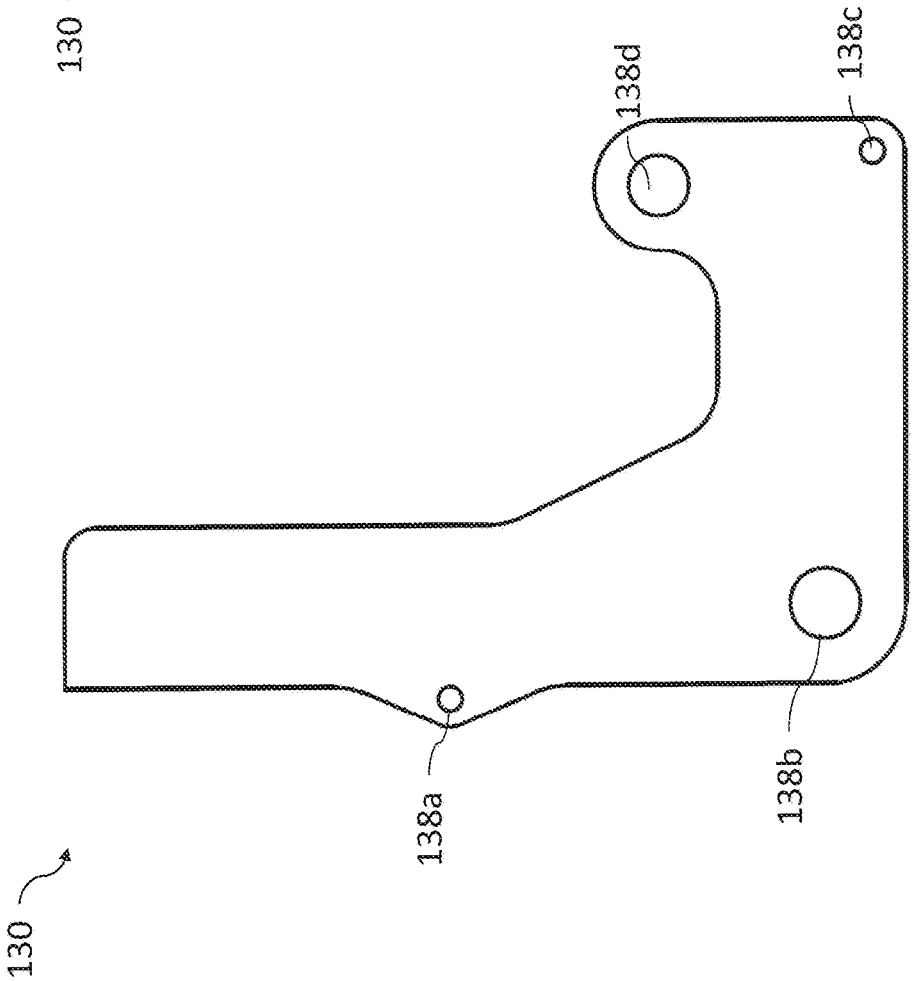
FIG. 5A depicts side view of a hinge plate, in accordance with certain aspects of the present disclosure.

FIGS. 5A and 5B depict hinge plate 130, including through-holes 138*a*, 138*b*, 138*c*, and 138*d*. In some aspects, hinge plates 130 are simple, torch cut shaped plates with multiple (e.g., four) machined holes there-through for receipt of pins. In some aspects, no welding, line-boring, or cheek plates are required for use of hinge plates 130 to connect shiplift platform 100 with pier 300.

Elimination of Complex End Weldments

In some aspects, shiplift platform 100, when installed at pier 300, extends under support pile 310 caps to connect with lifting apparatus 150 that are supported on the pile 310 caps. In some such aspects, shiplift platform 100 includes no complex weldments and/or no complex geometries (e.g., changes in the cross section of the main transvers girder(s) 110).

Safe Economical Platform Installation

In some aspects, shiplift platform 100 includes no projecting end weldments that are wider than the pile 310 spacing and platform opening (e.g., space 312). Shiplift platform 100, including movable connectors 2000, is configured (i.e., shaped, sized, and arranged) such that a fully assembled shiplift platform 100 is installable into a facility (i.e., pier 300) in a reduced time amount of time compared to a shiplift platform without movable connectors 2000, without using field welding or high-risk heavy tandem crane lifts employing multiple cranes. In some aspects, shiplift platform 100 is installable without requiring the performance of on-site, in-place welding and/or painting operations. In some aspects, shiplift platform 100 is fully assembled at a location remote for the site of installation, transported to the site of installation in a fully assembled configuration, and is installed at the site of installation while fully assembled without removal of movable connectors 2000. Thus, installation of shiplift platform 100 is simple. In some aspects, movable connectors 2000 allow a fully assembled shiplift platform 100 to be easily and quickly installed into a facility (i.e., into a pier).

Methods of Installation and/or Use

Some aspects of the present disclosure include a method of installing the shiplift platform disclosed herein. The method includes, with the movable connectors in the first position connected to the shiplift platform, floating the shiplift platform into position within a space adjacent a pier. The movable connectors are then moved from the first position into the second position. For example, hinge plates of the movable connectors may be swung upwards from below the shiplift platform into position for connection with lifting apparatus of the pier.

In some aspects, the shiplift platform is installed without using field welding, without using tandem crane lifts employing multiple cranes, or combinations thereof. In certain aspects, the shiplift platform is installed without the performance of on-site, in-place welding and/or painting operations.

In some aspects, the method includes fully assembling the shiplift platform, including the movable connectors, at a location remote for the pier, and then transporting the fully assembled shiplift apparatus to the pier. The shiplift platform may be transported on one or more barges to the pier.

The method may include lifting the shiplift platform using lifting apparatus of the pier. In some aspects, the method may include using the shiplift platform to dry dock and launch ships. The lifting apparatus may be used to lower the shiplift platform to a position underneath the water. A ship may be floated into the space defined by the pier (e.g., space 312). The lifting apparatus may then be used to raise the shiplift platform and ship above the water. The operation may be reversed to place the ship back into the water for launch.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A shiplift comprising:

a pier defining a space, the pier including lifting apparatus;

a shiplift platform that fits within the space defined by the pier; and one or more movable connectors coupled to the shiplift platform, wherein each movable connector is movable into at least two positions, the at least two positions including:

a first position, wherein in the first position the movable connector is coupled to the shiplift platform and is decoupled from the lifting apparatus; and a second position, wherein in the second position the movable connector is coupled to the shiplift platform and is positioned to couple to the lifting apparatus of the pier.

2. The shiplift of claim 1, wherein, in the first position, the shiplift platform is floatable into position adjacent the pier, within the space, without removal of the movable connectors from connection with the shiplift platform; and wherein, with the shiplift platform positioned within the space, adjacent the pier, the movable connectors are movable from the first position into the second position.

3. The shiplift of claim 2, wherein the movable connectors are coupled to the lifting apparatus, and wherein the lifting apparatus is configured to raise and lower the shiplift platform.

4. The shiplift of claim 1, wherein the movable connectors remain connected to the shiplift platform while in the first position, while in the second position, and while moving between the first and second positions.

5. The shiplift of claim 1, wherein the movable connectors are pivotable between the first position and the second position.

6. The shiplift of claim 1, wherein the movable connectors are hinged connectors that connect to the shiplift platform.

7. The shiplift of claim 1, wherein the space defined by the pier is formed between two portions of the pier, the space sufficiently sized and shaped to receive the shiplift platform.

8. The shiplift of claim 1, wherein the shiplift platform comprises a plurality of transverse girders coupled with longitudinal supports.

9. The shiplift of claim 8, wherein the one or more movable connectors are coupled to the transverse girders.

10. The shiplift of claim 1, wherein the movable connectors comprise gimbal plates coupled to the shiplift platform and hinge plates coupled to the gimbal plates.

11. The shiplift of claim 10, wherein, in the first position, the hinge plates and the gimbal plates are coupled to the shiplift platform, in a retracted position that provides clearance to maneuver the shiplift platform into the space defined by the pier; and wherein, in the second position the hinge plates are in a vertical or extended position, and arranged to couple with the lifting apparatus.

12. The shiplift of claim 11, wherein locking pins secure the hinge plates in the second position, and wherein shipping pins secure the hinge plates in the first position.

13. The shiplift of claim 10, wherein the lifting apparatus is coupled to the gimbal plates.

14. The shiplift of claim 13, wherein the lifting apparatus is coupled to the gimbal plates via lift chains and chain plates.

15. The shiplift of claim 1, wherein when the shiplift platform is coupled to the pier via the movable connectors, the movable connectors extend under support pile caps of the pier to connect with the lifting apparatus, wherein the lifting apparatus are supported on the pile caps.

16. The shiplift of claim 15, wherein the shiplift platform includes no projecting end weldments that are wider than a pile spacing and the space defined by the pier.

17. The shiplift of claim 1, wherein, in the first position, the movable connector is retracted to a position below the shiplift platform.

18. A shiplift platform comprising:

a platform;

one or more movable connectors coupled to the platform, wherein each movable connector is movable into at least two positions, the at least two positions including:

a first position, wherein in the first position the movable connector is coupled to the platform and is retracted to a position below the platform; and a second position, wherein in the second position the movable connector is coupled to the platform and is positioned to couple to a lifting apparatus of a pier.

19. The shiplift platform of claim 18, wherein the movable connectors are hinged connectors that connect to the platform.

20. The shiplift platform of claim 18, wherein the movable connectors comprise gimbal plates coupled to the platform and hinge plates coupled to the gimbal plates.

21. The shiplift platform of claim 20, wherein, in the first position, the hinge plates and the gimbal plates are coupled to the platform, in a retracted position that provides clearance to maneuver the platform into a space defined by a pier; and wherein, in the second position the hinge plates are in a vertical or extended position, and arranged for coupling with a lifting apparatus.

22. A method of installing a shiplift platform on a pier, the method comprising:

providing a shiplift platform having one or more movable connectors coupled therewith, wherein each movable connector is movable into at least two positions, the at least two positions including a first position and a second position;

with the movable connectors in the first position, floating the shiplift platform into position within a space defined by the pier, wherein in the first position the movable connectors are coupled to the shiplift platform;

moving the movable connectors from the first position into the second position, wherein in the second position the movable connectors are coupled to the shiplift platform and positioned to couple to lifting apparatus of the pier; and coupling the lifting apparatus of the pier with the movable connectors.

23. The method of claim 22, wherein the movable connectors are hinged connectors that connect to the shiplift platform.

24. The method of claim 22, wherein the movable connectors comprise gimbal plates coupled to the shiplift platform and hinge plates coupled to the gimbal plates.

25. A method of dry docking and launching floating vessels, the method comprising:

providing a shiplift, the shiplift comprising:

a pier defining a space, the pier including lifting apparatus;

a shiplift platform positioned within the space defined by the pier; and one or more movable connectors coupled to the shiplift platform, wherein each movable connector is movable into at least two positions, the at least two positions including:

a first position, wherein in the first position the movable connector is coupled to the shiplift platform and is decoupled from the lifting apparatus; and a second position, wherein in the second position the movable connector is coupled to the shiplift platform and is coupled to the lifting apparatus of the pier;

dry docking a floating vessel by:

lowering the shiplift platform to a position underneath the water using the lifting apparatus;

receiving a floating vessel positioned above the shiplift platform, the floating vessel floated into the space defined by the pier; and raising the shiplift and the floating vessel to a position above the water using the lifting apparatus.

26. The method of claim 25, wherein the movable connectors are hinged connectors that connect to the shiplift platform.

27. The method of claim 25, wherein the movable connectors comprise gimbal plates coupled to the shiplift platform and hinge plates coupled to the gimbal plates.

28. A method of making a shiplift platform, the method comprising:

coupling one or more movable connectors to a shiplift platform, wherein each movable connector is movable into at least two positions, the at least two positions including:

a first position, wherein in the first position the movable connector is coupled to the shiplift platform and is decoupled from the lifting apparatus; and a second position, wherein in the second position the movable connector is coupled to the shiplift platform and is positioned to couple to a lifting apparatus of a pier.

29. The method of claim 28, wherein the movable connectors are hinged connectors that connect to the shiplift platform.

30. The method of claim 28, wherein the movable connectors comprise gimbal plates coupled to the shiplift platform and hinge plates coupled to the gimbal plates.

* * * * *